US009909601B2

(12) United States Patent
Heerdt et al.

(10) Patent No.: US 9,909,601 B2
(45) Date of Patent: Mar. 6, 2018

(54) MOTOR CONTROL

(75) Inventors: Dieter Bernhard Heerdt, Hendersonville, TN (US); David Michael Folmer, Castalian Springs, TN (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 1350 days.

(21) Appl. No.: 12/947,634

(22) Filed: Nov. 16, 2010

(65) Prior Publication Data

US 2012/0118136 A1 May 17, 2012

(51) Int. Cl.
*F15B 15/28* (2006.01)

(52) U.S. Cl.
CPC ..... *F15B 15/2861* (2013.01)

(58) Field of Classification Search
CPC .. F15B 15/28; F15B 15/2815; F15B 15/2892; F15B 15/1433; F15B 15/1438; F15B 15/202; F15B 15/2861; F04B 2201/0201; G01B 7/003
USPC ..... 91/1, 361; 92/5 R
See application file for complete search history.

(56) References Cited

U.S. PATENT DOCUMENTS 2,755,966 A * 7/1956 Lindars ..... 222/23
4,343,597 A 8/1982 Brown
4,778,353 A 10/1988 Wiernicki
4,846,048 A 7/1989 Hvilsted et al.
4,857,842 A 8/1989 Sturman et al.
4,901,628 A * 2/1990 Krage ..... 92/5 R
4,987,822 A * 1/1991 Stoll ..... 91/358 R
5,114,752 A 5/1992 Hall
5,201,838 A * 4/1993 Roudaut ..... 294/206
5,275,539 A 1/1994 Custer et al.
5,325,762 A 7/1994 Walsh et al.
5,351,599 A * 10/1994 Stoll ..... 91/1
5,985,357 A 11/1999 Sanada
(Continued)

FOREIGN PATENT DOCUMENTS

CN 2539019 Y 3/2003
CN 1784549 A 6/2006
(Continued)

OTHER PUBLICATIONS

JPH05-65907A machine translation to English from espacenet. 1993.*
(Continued)

*Primary Examiner* — Logan Kraft
*Assistant Examiner* — Michael Quandt
(74) *Attorney, Agent, or Firm* — Levenfeld Pearlstein, LLC

(57) ABSTRACT

A motor control system includes a piston chamber and a piston assembly disposed within the piston chamber to move therein between first and second positions. A magnet is coupled to the piston assembly to move therewith and a sensor is axially mounted with respect to the piston assembly to generate a continuous output signal corresponding to a position of the magnet relative to the sensor. The motor control system also includes a controller for processing the output signal from the sensor to monitor continuously the position of the piston assembly within the piston chamber and for actuating the piston assembly to move in an upstroke toward the first position and in a downstroke toward the second position.

14 Claims, 2 Drawing Sheets

(56) References Cited

U.S. PATENT DOCUMENTS

| | | | | |
|---|---|---|---|---|
| 6,155,806 | A * | 12/2000 | Andel | 417/523 |
| 6,257,118 | B1 * | 7/2001 | Wilbur et al. | 91/361 |
| 6,334,553 | B1 | 1/2002 | Bouras et al. | |
| 6,510,719 | B2 * | 1/2003 | Goop | 72/3 |
| 6,607,360 | B2 | 8/2003 | Fong | |
| 6,690,160 | B2 | 2/2004 | Gray et al. | |
| 6,729,849 | B2 | 5/2004 | Fong | |
| 6,736,611 | B2 * | 5/2004 | Putt et al. | 417/386 |
| 6,755,115 | B2 * | 6/2004 | Stoll et al. | 91/363 R |
| 6,886,333 | B2 | 5/2005 | Feigel et al. | |
| 7,007,563 | B2 * | 3/2006 | Spiegl et al. | 73/865.9 |
| 7,018,477 | B2 | 3/2006 | Engel | |
| 7,023,199 | B2 * | 4/2006 | Blubaugh et al. | 324/207.13 |
| 7,051,904 | B2 | 5/2006 | Jeter | |
| 7,123,003 | B2 | 10/2006 | Jagiella et al. | |
| 7,218,099 | B2 | 5/2007 | Yamamoto et al. | |
| 7,263,781 | B2 | 9/2007 | Sielemann | |
| 7,381,035 | B2 | 6/2008 | Riney | |
| 7,520,208 | B2 * | 4/2009 | Beuth et al. | 91/363 R |
| 7,726,516 | B2 | 6/2010 | Engel | |
| 7,735,447 | B2 * | 6/2010 | Nguyen | 118/323 |
| 8,024,923 | B2 * | 9/2011 | Matsumoto | 60/407 |
| 8,453,441 | B2 * | 6/2013 | Williamson et al. | 60/446 |
| 2004/0011194 | A1 * | 1/2004 | Lederer et al. | 92/5 R |
| 2004/0261608 | A1 * | 12/2004 | Bugel et al. | 91/465 |
| 2006/0075892 | A1 | 4/2006 | Dorr | |
| 2006/0232268 | A1 | 10/2006 | Arns et al. | |
| 2008/0250918 | A1 | 10/2008 | Strong | |
| 2008/0250919 | A1 | 10/2008 | Strong | |
| 2008/0253906 | A1 * | 10/2008 | Strong | 417/321 |
| 2009/0015243 | A1 | 1/2009 | Asa | |
| 2010/0039103 | A1 | 2/2010 | Lenz et al. | |
| 2010/0126600 | A1 * | 5/2010 | Watson | 137/486 |
| 2010/0258592 | A1 | 10/2010 | Tracy et al. | |

FOREIGN PATENT DOCUMENTS

| | | | | |
|---|---|---|---|---|
| EP | 0589802 | A1 | | 3/1994 |
| EP | 0620647 | A2 | | 10/1994 |
| EP | 0805279 | A2 | | 11/1997 |
| EP | 1327482 | A2 | | 7/2003 |
| JP | S59-083202 | U | | 5/1984 |
| JP | S61-164803 | U | | 10/1986 |
| JP | 01069806 | A | | 3/1989 |
| JP | H05-65907 | A | * | 3/1993 |
| JP | H05-240214 | A | | 9/1993 |
| JP | H06-076705 | U | | 3/1994 |
| JP | H06-222816 | A | * | 8/1994 |
| JP | H06-509423 | A | | 10/1994 |
| JP | 2010048698 | A | | 3/2010 |
| WO | 88/07713 | A1 | | 10/1988 |
| WO | 2008006030 | A2 | | 1/2008 |
| WO | 20100088931 | A1 | | 8/2010 |

OTHER PUBLICATIONS

JPH06-222816A machine translation to English from espacenet. 1994.*

International Search Report and the Written Opinion of the International Searching Authority Issued in Connection with PCT/US2011/060844 dated Jun. 15, 2012.

* cited by examiner

MOTOR CONTROL

BACKGROUND OF THE INVENTION

1. Field of the Invention

The present invention is directed to a motor control and, more specifically, to a motor control that is configured to track the position of a piston in a motor.

2. Background of the Invention

Motors that include a piston actuated or energized to move within a piston chamber to perform mechanical work are known. Further, control systems for controlling the actuation of the piston within the piston chamber are known. In one example, a photoelectronic sensor is configured to generate a signal when the piston reaches one end of the piston chamber. In the present example, the signal generated by the photoelectronic sensor is a digital signal that provides only discrete, discontinuous position data when the piston has reached the end of the piston chamber.

In another example, a magnetic hall sensor is disposed on a circumferential wall that defines the piston chamber and a magnet is coupled to the piston. In the present example, the hall sensor functions similarly to the example above, wherein the hall sensor generates a discrete signal when the magnet passes by the hall sensor to determine an instantaneous position of the piston as it passes by the hall sensor. For some applications, such discrete data is sufficient for satisfactory control the motor.

However, other applications require or at least could be benefitted by greater precision and reliability in controlling the actuation of the piston within the piston chamber. In such applications, improved tracking of the piston is one consideration to facilitate the greater precision and reliability in controlling the actuation of the piston. The present disclosure is directed to such a control with improved tracking of a piston.

SUMMARY OF THE INVENTION

According to one example, a motor control system includes a piston chamber and a piston assembly disposed within the piston chamber to move therein between first and second positions. A magnet is coupled to the piston assembly to move therewith and a sensor is axially mounted with respect to the piston assembly to generate a continuous output signal corresponding to a position of the magnet relative to the sensor. The motor control system also includes a controller for processing the output signal from the sensor to monitor continuously the position of the piston assembly within the piston chamber and for actuating the piston assembly to move in an upstroke toward the first position and in a downstroke toward the second position.

According to another example, a motor control system includes an end cap housing for mounting on an axial end of a piston chamber and a sensor coupled to the housing. The sensor is configured to generate a continuous output signal corresponding to a position of a piston assembly within the piston chamber. Further, a controller is coupled to the sensor for processing the output signal from the sensor and monitoring continuously the position of the piston assembly.

According to a further example, a motor control system includes a piston chamber, a piston assembly disposed within the piston chamber to move therein between first and second positions, and a sensor axially mounted with respect to the piston assembly to generate an output signal corresponding to a position of piston assembly relative to the sensor. The system also includes a controller for processing the output signal from the sensor to monitor the position and velocity of the piston assembly as the piston assembly is moved between the first and second positions and for actuating the piston assembly to move in an upstroke toward the first position and in a downstroke toward the second position.

These and other features and advantages of the present invention will be apparent from the following detailed description, in conjunction with the appended claims.

BRIEF DESCRIPTION OF THE DRAWINGS

Details of the present invention, including non-limiting benefits and advantages, will become more readily apparent to those of ordinary skill in the relevant art after reviewing the following detailed description and accompanying drawings, wherein.

DETAILED DESCRIPTION

Figure 1:
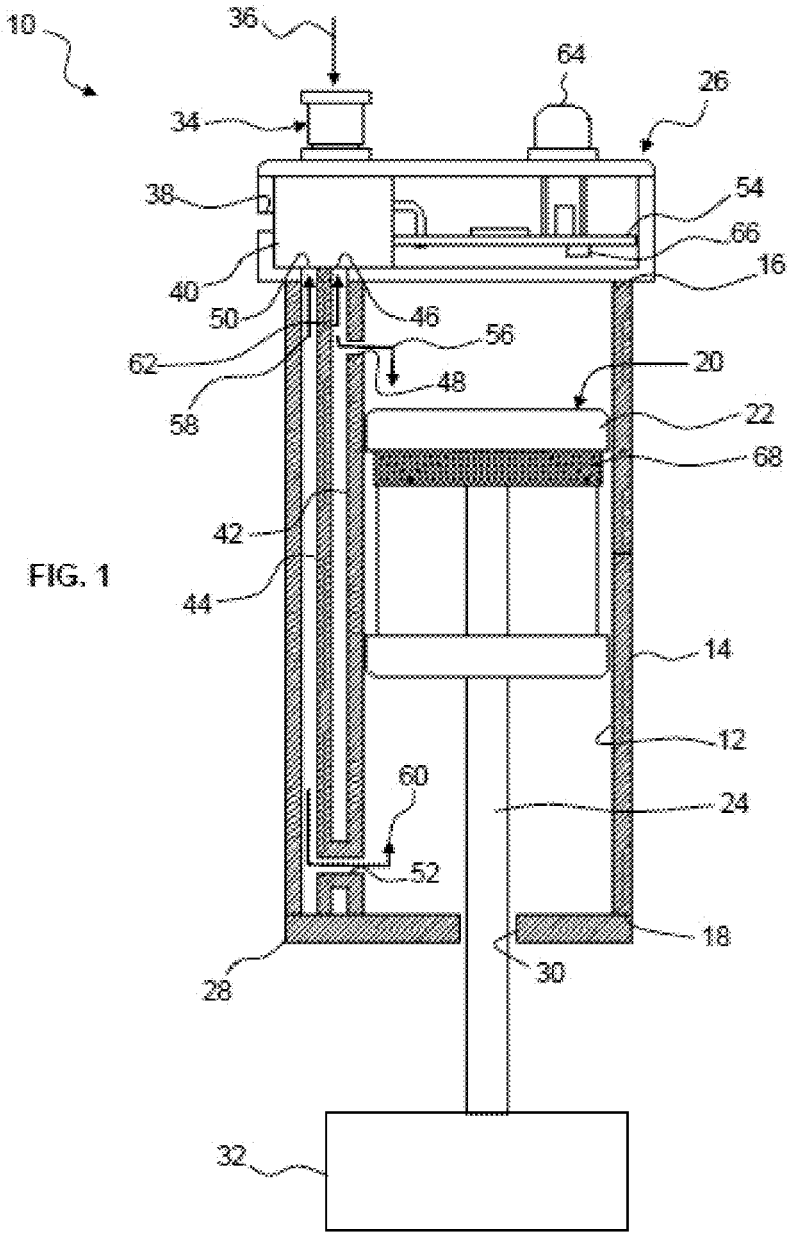
FIG. 1 is a diagrammatic, side elevational, and partially cross-sectional view of a motor assembly according to one embodiment.

While the present invention is susceptible of embodiment in various forms, there is shown in the drawings and will hereinafter be described one or more embodiments with the understanding that the present disclosure is to be considered illustrative only and is not intended to limit the invention to any specific embodiment disclosed herein.

FIG. 1 illustrates a motor assembly 10 that includes a piston chamber 12 defined by a circumferential sidewall 14 having first and second opposing ends 16, 18, respectively. A piston assembly 20 is disposed within the piston chamber 12 and is energized or actuated within the piston chamber to move therein. In one example, the piston chamber 12 is substantially cylindrical and the piston assembly 20 is configured to move axially within the chamber. The piston assembly 20 includes a piston head 22 coupled to a pump shaft 24. The first end 16 of the piston chamber 12 is sealed by an end cap housing 26 that can be configured to provide an easily maintained and replaced single housing for all of the control components of the motor assembly 10, as is shown in FIG. 1 and as will be described in more detail hereinafter. The second end 18 of the piston chamber is sealed by an end wall 28. An opening 30 in the end wall 28 allows the pump shaft 24 to extend therethrough so that the pump shaft can be coupled to a separate system 32 to perform work thereon. In one example intended without limitation, the separate system 32 can be an adhesive dispensing system and the pump shaft 24 can be coupled thereto to precisely meter and dispense adhesive from the system 32. A seal (not shown) may be disposed between the opening 30 in the end wall 28 and the pump shaft 24 to provide a substantially fluid-tight seal, as would be apparent to one of ordinary skill.

The end cap housing 26 includes a fluid port 34 for coupling to a fluid supply. In the present embodiment, the fluid port 34 functions as a fluid inlet designated generally by the arrow 36. The end cap housing 26 also includes an exhaust outlet port 38. According to one non-limiting example, the fluid port 34 can be coupled to a supply of pressurized air. In other examples, the fluid port 34 may be coupled to a supply of other suitable fluids, such as oil, water, and the like. The end cap housing 26 also includes a valve mechanism 40 fluidly coupled to the port 34 for directing a fluid flow to actuate and move the piston assembly 20 within the chamber 12 and to the exhaust outlet 38 to allow fluid to exit the chamber, as will be described in more detail hereinafter. The valve mechanism 40 may include one or more electrically actuated valves. In one example, the valve mechanism 40 includes one or more single or multi-port solenoid valves, such as one or more three-way and four-way solenoid valves, as would be apparent to one of ordinary skill in the art.

The circumferential sidewall 14 includes a first duct 42 and a second duct 44. The first duct 42 includes a first inlet 46 coupled to the valve 40 and a first outlet 48 into the piston chamber 12 at a point generally proximate the first end 16 of the piston chamber. The second duct 44 includes a second inlet 50 coupled to the valve 40 and a second outlet 52 into the piston chamber 12 at a point generally proximate the second end 18 of the piston chamber.

The end cap 26 housing also includes a printed circuit board ("PCB") 54 that controls the valve 40 to direct a flow of fluid, such as pressurized air, to drive the piston assembly 20 in a downstroke toward the second end 18 of the piston chamber 12 and in an upstroke toward the first end 16 of the piston chamber. More particularly, during the downstroke, the valve 40 opens a fluid flow path represented by an arrow 56 between the port 34 and the first inlet 46 of the first duct 42 to allow the fluid to flow out through the first outlet 48 into the piston chamber 12 and drive the piston assembly 20 toward the second end 18. During the downstroke, the valve 40 may also open a fluid flow path represented by an arrow 58 between the second duct 44 and the exhaust outlet 38 to allow fluid to exit the chamber 12 as the piston assembly is moved toward the second end 18. Similarly, during the upstroke, the valve 40 opens a fluid flow path represented by an arrow 60 between the port 34 and the second inlet 50 of the second duct 44 to allow the fluid to flow out through the second outlet 52 into the piston chamber 12 and drive the piston assembly 20 toward the first end 16. During the upstroke, the valve 40 may also open a fluid flow path represented by an arrow 62 between the first duct 42 and the exhaust outlet 38 to allow fluid to exit the chamber 12 as the piston assembly is moved toward the first end 16.

An electrical connection 64 may also be disposed on the end cap housing 26 for supplying electrical power to the PCB 54, the valve 40, and/or any other electrical or electromechanical components of the motor assembly 10.

The motor assembly 10 further includes a sensor 66, such as a hall sensor, capable of generating a continuous, analog signal corresponding to a position of a magnet 68 disposed on the piston assembly 20. The magnet 68 may be ring-shaped, disk-shaped, or any other appropriate shape and is disposed on the piston assembly 20 in any known manner, such as by adhesive, screws, clamps, an interference fit, etc. In FIG. 1, the sensor 66 is coupled to the end cap housing 26 and is disposed axially in relation to the movement of the piston assembly 20 within the piston chamber 12. The sensor 66 is further coupled to the PCB 54, which processes signals from the sensor to track continuously the position of the magnet 68 and the piston assembly 20 within the piston chamber 12. The placement of the sensor 66 at an axial end of the chamber 12 facilitates the continuous tracking of the magnet 68 and piston assembly 20.

Figure 2:
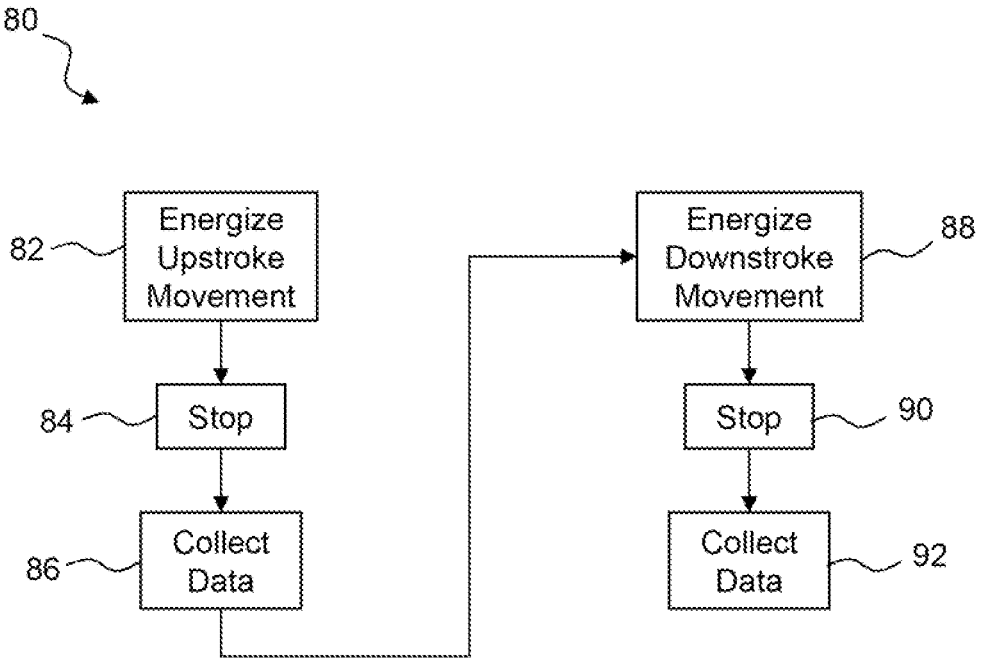
FIG. 2 is a flowchart illustrating a procedure performed to calibrate the motor assembly of FIG. 1.

Referring now to FIG. 2, the PCB 54 and/or some other control system may perform a calibration mode or procedure 80 to collect relevant data before, during, and/or after the motor assembly 10 is utilized in a given application. The calibration procedure 80 begins at a block 82, whereby the piston assembly 20 is energized or actuated to move in an upstroke towards the first end 16 of the piston chamber 12, as described above. The piston assembly 20 is moved in the upstroke until the piston head 22 stops at a block 84. In one example, the piston head 22 is mechanically stopped at the block 84, such as when the piston head reaches the end of the chamber 12. Thereafter, at a block 86, the PCB 54 collects and stores data, such as the position of the piston assembly 20 when it is stopped at the block 84. Position data collected at the block 86 may correspond to an upper limitation of the piston head 20 within the piston chamber 12.

After the block 86, control passes to a block 88, and the piston assembly 20 is energized to move in a downstroke towards the second end 18 of the piston chamber 12, as described above. The piston assembly 20 is moved in the downstroke until the piston head 22 stops at a block 90. Similarly to the block 84, the piston head can be mechanically stopped at the block 90, such as by reaching the end of the chamber 12. Thereafter, at a block 92, the PCB 54 collects and stores data, such as the position of the piston assembly 20 when it is stopped at the block 90. The position data collected at the block 92 may correspond to a lower limitation of the piston head 20 within the piston chamber 12.

Various modifications can be made to the calibration procedure 80 of FIG. 2 without departing from the spirit of the present disclosure. For example, the blocks 82, 88 may be performed in any order to collect data regarding the upper and lower limitations. Further, data can be collected continuously as the piston assembly 20 is moved between the upper and lower limitations and the collected data may include the position, velocity, acceleration, and other parameters of the motor assembly 10 in use.

Figure 3:
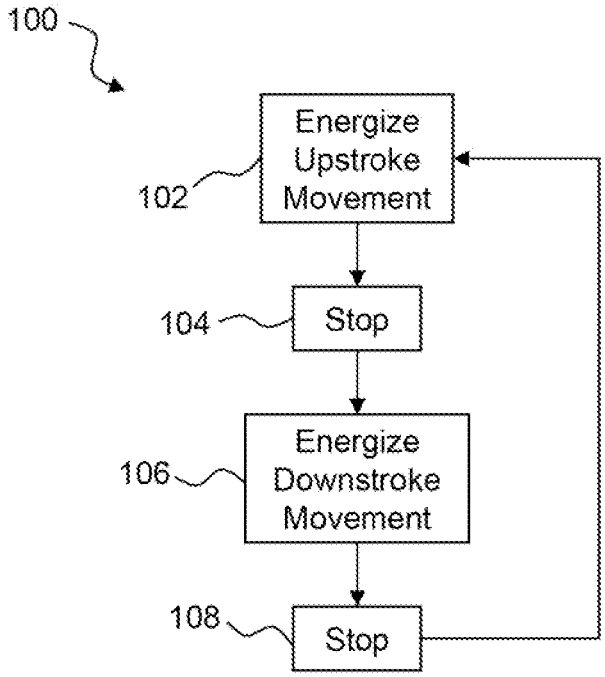
FIG. 3 is a flowchart illustrating a normal operating mode of the motor assembly.

FIG. 3 illustrates one example of a normal operating mode or procedure 100 during which the piston assembly 20 is energized or actuated to cause the piston assembly to travel between the upper and lower limitations. More particularly, the piston assembly 20 is energized to move in an upstroke at a block 102 until the piston assembly 20 is stopped at a block 104. In one example, the PCB 54 stops the piston assembly 20 at the block 104 utilizing the calibration data, instead of a mechanical stop similar to the blocks 84 and 90. After the block 104, the piston assembly is energized to move in a downstroke at a block 106 until the piston assembly is stopped at a block 108. Similarly to the block 104, the PCB 54 can stop the piston assembly at the block 108 utilizing the calibration data, instead of a mechanical stop. After the block 108, control passes back to the block 102 and the process of driving the piston assembly 20 within the piston chamber 12 is repeated. The blocks 104, 108 utilize the calibration data, such as the positions of the piston assembly 20 at the upper and lower limitations, and may stop the piston assembly 20 at any position within the piston chamber 12, such as at the upper and lower limitations or anywhere therebetween. In one embodiment, the blocks 102-108 energize the piston assembly 20 to travel between the upper and lower limitations minus a small margin to compensate for tolerances and drifts of the motor assembly 10. Further, the blocks 104, 108 may stop the piston assembly 20 instantaneously as the piston assembly is transitioned between the upstroke and downstroke or may stop the piston assembly for a longer period of time.

During the actuation of the piston assembly 20 to move within the chamber 12 at the blocks 102-108, the sensor 66 can continuously generate position data for the magnet 68 and the piston assembly 20. The PCB 54 can use this continuous position data to accurately control actuation of the piston assembly 20 and operation of the motor assembly 10. Further, the continuous tracking of the position of the piston assembly 20 allows the PCB 54 to determine a velocity and acceleration thereof as the assembly moves within the piston chamber 12. The velocity and/or acceleration data can be used to check the proper operation of the valve mechanism 40 that directs fluid flow through the first and second ducts 42, 44. For example, a direction of quick stroking based on the velocity and/or acceleration data may indicate one or more fluid flow paths being stuck open.

The PCB 54 can also use the position data to log strokes or cycles of the piston assembly 20 and provide maintenance reminders and stroke/cycle limiting functions for portions of the motor assembly 10 or the separate system 32. Further, the PCB 54 can use the position data to adjust a stroke length and/or timing of the piston assembly 20 within the piston chamber 12 in applications, such as, but not limited to adhesive pattern control. Another potential benefit is the ability to precisely detect and correct for stalling of the piston assembly 20 mid stroke. Still further, the position data can be used to calculate a flow rate and consumption of a substance, such as an adhesive. Another possible benefit or application is to tie the position data with a melt rate of the adhesive or glue and to control the piston speed and strokes per minute accordingly.

The PCB 54 can also control the valve 40 to direct a fluid flow, such as pressurized air, through the first and second ducts 42, 44 simultaneously. In one example, the block 104 controls the transition between the upstroke (block 102) and the downstroke (block 106). During the block 104, the PCB 54 can control the valve 40 to begin opening the fluid flow path 56 so that fluid begins to flow into the piston chamber 12 from the first end 16 even as fluid is flowing through the second duct 44 to drive the piston assembly 20 upward. As the piston assembly 20 nears the stop position of the block 104, the PCB 54 can control the valve 40 to continue opening the fluid flow path 56 as the valve closes the fluid flow path 60 between the port 34 and the second duct 44. This control of fluid through both the first and second ducts 42, 44 helps provide a smooth transition between upstrokes and downstrokes and helps compensate for switching times between upstrokes and downstrokes.

Likewise, the block 106 controls the transition between the downstroke (block 106) and the upstroke (block 102). During the block 106, the PCB 54 can control the valve 40 to begin opening the fluid flow path 60 so that fluid begins to flow into the piston chamber 12 from the second end 18 even as fluid is flowing through the first duct 42 to drive the piston assembly 20 downward. As the piston assembly 20 nears the stop position of the block 108, the PCB 54 can control the valve 40 to continue opening the fluid flow path 60 as the valve closes the fluid flow path 56 between the port 34 and the first duct 42.

Other embodiments include all of the various combinations of individual features of each of the embodiments and examples described and/or claimed herein.

In the present disclosure, the words "a" or "an" are to be taken to include both the singular and the plural. Conversely, any reference to plural items shall, where appropriate, include the singular.

INDUSTRIAL APPLICABILITY

The motor control disclosed herein is configured to track accurately and continuously a position of a piston within a motor to provide greater precision and reliability in controlling the actuation of the piston. According to one example, the motor control can be used in an adhesive dispensing system to precisely meter and dispense the adhesive Numerous modifications to the present disclosure will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. A motor control system, comprising:

a piston chamber defined by a radially inner surface of a circumferential sidewall, the circumferential sidewall further having a radially outer surface such that a thickness of the circumferential sidewall is defined between the radially inner surface and the radially outer surface, the chamber having first and second axial ends;

a piston assembly disposed within the piston chamber to move therein between first and second axial ends;

a magnet coupled to the piston assembly to move therewith;

an end cap housing externally positioned at the first axial end of the piston chamber to seal the first axial end;

a sensor axially mounted with respect to, and axially spaced from, the piston assembly to generate a continuous output signal corresponding to a position of the magnet relative to the sensor, wherein the sensor is mounted to the end cap housing; and a controller mounted to the end cap housing for processing the output signal from the sensor to monitor continuously the position of the piston assembly within the piston chamber and for actuating the piston assembly to move in an upstroke toward the first position and in a downstroke toward the second position, wherein the end cap housing includes a fluid inlet, an exhaust outlet port, and an electrically actuated valve mechanism fluidly coupled to the inlet for directing the fluid to move the piston assembly between the first and second positions, wherein the circumferential sidewall has formed in the thickness thereof a first duct and a second duct, each of the first duct and the second duct fluidically connecting the chamber to the fluid inlet and the exhaust outlet port, wherein the controller is configured to operate the valve mechanism to open a first fluid flow path formed in the first duct and end cap housing during an upstroke to direct the fluid to move the piston assembly toward the first axial end and to open a second fluid flow path formed in the second duct and the end cap housing during the downstroke to direct the fluid to move the piston assembly toward the second axial end, and wherein the piston assembly includes a piston head and a pump shaft, and the magnet is disposed proximal to the piston head and axially spaced from the sensor, and the pump shaft is coupled to a dispensing device to drive the dispensing device to meter and dispense adhesive from the dispensing device.

2. The motor control system of claim 1, wherein the controller is configured to control the first and second fluid flow paths to both be at least partially open when the piston assembly is transitioned between the upstroke and downstroke.

3. The motor control system of claim 1, wherein the valve mechanism is a solenoid valve and the fluid is pressurized air.

4. The motor control system of claim 1, wherein the sensor is a hall sensor.

5. The motor control system of claim 1, wherein the controller is configured to perform a calibration procedure, which includes moving the piston in the upstroke until the piston is at the first position, storing data relating to the first position, moving the piston in the downstroke until the piston is at the second position, and storing data relating to the second position.

6. The motor control system of claim 1, wherein the piston chamber is substantially cylindrical and the piston assembly is disposed therein to move axially between the first and second axial ends.

7. A motor control system, comprising:

an end cap housing for externally mounting on an axial end of a piston chamber to seal the axial end;

a sensor coupled to the end cap housing and spaced from the piston chamber, wherein the sensor is configured to generate a continuous output signal corresponding to a position of a piston assembly within the piston chamber; and a controller coupled to the sensor for processing the output signal from the sensor and monitoring continuously the position of the piston assembly, wherein the end cap housing further includes an inlet for a fluid, an exhaust outlet for the fluid, and an electrically actuated valve for controlling a flow of the fluid, wherein the end cap housing further includes a first fluid flow path and a second fluid flow path fluidically connected to first and second ducts formed in a thickness of a sidewall of the piston chamber, wherein the controller is configured to operate the valve to selectively open the first and second fluid flow paths to direct the fluid to opposite sides of the piston assembly move the piston assembly within the piston chamber, and wherein the piston assembly includes a piston head and a pump shaft, and the pump shaft is coupled to a dispensing device to drive the dispensing device to meter and dispense adhesive from the dispensing device.

8. The motor control system of claim 7, wherein the valve is a solenoid valve.

9. The motor control system of claim 7, wherein the sensor is a hall sensor that is configured to generate a continuous output signal corresponding to a position of a magnet coupled to the piston assembly.

10. The motor control system of claim 7, wherein the housing further includes an electrical connection for supplying power to electrical components of the controller.

11. The motor control system of claim 7, wherein the sensor and the controller are disposed within the end cap housing.

12. A motor control system, comprising:

a piston chamber defined by a circumferential sidewall, the chamber having a first end and a second end;

a piston assembly disposed within the piston chamber to move therein between first and second ends;

an end cap housing externally positioned at the first end of the piston chamber;

a sensor axially mounted with respect to the piston assembly and positioned axially beyond a travel path of the piston assembly defined within the piston chamber, to generate an output signal corresponding to a position of the piston assembly relative to the sensor, wherein the sensor is coupled to the end cap housing; and a controller coupled to the end cap housing for processing the output signal from the sensor to monitor the position and velocity of the piston assembly as the piston assembly is moved between the first and second positions and for actuating the piston assembly to move in an upstroke toward the first position and in a downstroke toward the second position, wherein the end cap housing further includes an inlet for a fluid, and outlet for the fluid, and an electrically actuated valve mechanism fluidly coupled to the inlet and the outlet and controlled by the controller to direct the fluid in a first duct and a second duct formed in a thickness of the sidewall and disposed in fluid communication with the piston chamber to move the piston assembly in the upstroke and the downstroke between the first and second positions, and wherein the piston assembly includes a piston head and a pump shaft, and the magnet is disposed proximal to the piston head and axially spaced from the sensor, and the pump shaft is coupled to a dispensing device to drive the dispensing device to meter and dispense adhesive from the dispensing device.

13. The motor control system of claim 12, wherein the controller continuously monitors the position and velocity of the piston assembly.

14. The motor control system of claim 12, wherein the controller is configured to perform a calibration procedure, which includes moving the piston in the upstroke until the piston is at the first position, storing data relating to the first position, moving the piston in the downstroke until the piston is at the second position, and storing data relating to the second position.

* * * * *